United States Patent [19]

Prot

[11] 4,057,444

[45] Nov. 8, 1977

[54] METHOD FOR MANUFACTURE OF CONTAINERS, PARTICULARLY FOR PACKING PURPOSES

[75] Inventor: Marcel G. Prot, Bercheres-sur-Vesgre, France

[73] Assignee: The Mead Corporation, Dayton, Ohio

[21] Appl. No.: 614,169

[22] Filed: Sept. 16, 1975

[30] Foreign Application Priority Data

| | | |
|---|---|---|
| Sept. 20, 1974 | France | 74.31886 |
| Aug. 27, 1975 | France | 75.26439 |

[51] Int. Cl.[2] ..... B65B 7/28

[52] U.S. Cl. ..... 156/69; 53/38; 93/55.1 P; 93/39.1 P; 156/242; 156/267; 156/512; 264/92; 264/248; 264/249

[58] Field of Search ..... 264/248, 249, 92; 93/36.05, 39.1 R, 39.1 P, 55.1 R, 55.1 P; 53/38; 156/69, 262, 267, 242, 512

[56] References Cited

U.S. PATENT DOCUMENTS

| | | | |
|---|---|---|---|
| 2,188,963 | 2/1940 | Seybold | 229/5.7 |
| 2,409,460 | 10/1946 | Waters | 93/55.1 |
| 3,336,847 | 8/1967 | Durat | 93/36.5 |

FOREIGN PATENT DOCUMENTS

| | | |
|---|---|---|
| 2,174,588 | 12/1973 | France. |
| 1,411,995 | 5/1971 | Germany. |

*Primary Examiner*—Edward G. Whitby
*Attorney, Agent, or Firm*—Browdy and Neimark

[57] ABSTRACT

A container, particularly for packing purposes, a method for manufacturing it and a machine for carrying out the method are described. The container comprises a cardboard sheath, a film of a material having thermobonding characteristics innerly lining the cardboard sheath at least close to its bottom end, a plastic bottom having a peripheral rim integral with the sheath by being bonded on a margin of said film and, at its end opposite to the bottom, a flange made of the same plastic material as that which makes the bottom, said flange being made integral with said sheath by the usual thermobonding techniques.

8 Claims, 23 Drawing Figures

10
11
12
13
14
15
20
21
22
23
27
28
29
30
33
35
36
37
38
39
C

METHOD FOR MANUFACTURE OF CONTAINERS, PARTICULARLY FOR PACKING PURPOSES

FIELD OF THE INVENTION

This invention relates to a container, particularly, for packing, to a method for its manufacture and to a machine for carrying out the method.

BACKGROUND OF THE INVENTION

Packing containers are already knwon, for example, according to French Pat. No. 2,174,588 which consists of a cardboard body or sheath sealed at least at one of its ends by a plastic bottom which is made integral with the sheath.

In such known containers, the bottom and, if necessary the cover of the container are manufactured using the techniques of injection of plastic material, relatively complex and expensive.

A packing container is also known, according to the published German Patent Application No. 1,454,953, which consists of a lining made of paper or plastic material closed at one of its ends by a plastic bottom made integral with the lining and manufactured by thermoforming. When such containers comprise a paper lining, they cannot be used for liquid, viscous or pasty products, for example milk foods, and this is due to the insufficient tightness of the plastic bottom connection to the paper lining, the usual plastic materials being not weldable to paper. When such containers comprise a plastic lining, they involve, for their manufacture, a substantial consumption of raw material, the price of which, constantly substantially increasing, causes a rise in the price of the container such that its commercial exploitation cannot be assured.

SUMMARY OF THE INVENTION

One object of the invention is to provide a container, particularly, for packing, a method for its manufacture and a machine for carrying out the method, which obviate the drawbacks of the known methods and devices mentioned above.

In this respect, one object of the present invention is to provide a container, particularly, for packing, comprising a cardboard sheath or lateral wall and a plastic bottom integral with the sheath by a bond of both excellent quality, as far as mechanical resistance is concerned, and which is completely tight with respect to the container's content and which further is easily closable at its upper part by a closing cover, for example a lid made of aluminum foil or similar material.

It is also an object of the present invention to provide a container on the walls of which the application of a printed inscription is very easy.

The object of the present invention is also to provide a manufacturing method for such a container in which only the bottom is made of thermoformed plastic thus limiting the cost of the container to a value which is compatible with its commercial distribution and exploitation.

The container according to the present invention which comprises a cardboard sheath or lateral wall and a plastic bottom with a rim which is made integral with the sheath by thermowelding or thermobonding on a margin of a film of material having thermoweldability or thermobonding characteristics innerly lining the cardboard sheath at least close to its bottom end is characterized in that it further comprises, at its end opposite to the bottom, a flange of the same plastic material as that making the bottom and made integral with the sheath using the usual thermobonding, thermosealing or similar techniques.

The film may be a plastic or paraffin film or a coating of the "hot-melt", adhesive "hot-melt" type or a thermosealing varnish.

The material making the bottom is chosen as a function of its working properties through thermoforming, and, if need be, the characteristics required as a whole for this material are obtained using a composite plastic sheet consisting of two or of a greater number of layers of different natures, such as a layer of polystyrene to provide the required rigidity and a layer of polyethylene designed to come in contact with the product to be packed when the latter is, for example, a fruit juice.

The method according to the present invention for manufacturing the container, comprising a cardboard sheath or lateral wall and a plastic bottom shaped through thermoforming of a plastic sheet to provide a peripheral rim having the same cross section as that of said sheath, said rim being made integral with the sheath through thermowelding or thermobonding on a margin of a film of material having thermoweldability or thermobonding characteristics lining the inside of the sheath at least close to its bottom end, is characterized in that, after the bottom of the container has been parted form the simple or composite plastic sheet from which it was formed, the upper part of the container is brought in front of said sheet, which is then hollowed out in correspondance of said bottom and which presents a flange conjugated with that of the rim, and in that the flange formed on the sheet is made integral with said sheath through thermowelding or thermobonding on a band of thermosealing plastic material or varnish lining the exterior of the cardboard sheath close to its end opposite to the bottom.

There is thus obtained, on the upper part of the container, a plastic surface on which may be sealed, in a manner known per se, a closing cover, for example, a lid made of aluminum foil or similar material. In additon, almost the entire sheet of simple or composite plastic material from which the bottom originated is thus used, which limits raw material losses to a very low value.

The method according to the present invention is advantageously carried out by means of a machine providing for the simultaneous, continuous or semi-continuous manufacture of a plurality of containers, so that attachment through thermowelding or thermobonding of all the flanges of a given blank with the upper parts of the sheaths of said plurality of containers connects said containers to one another. By cutting out of the blank along the contour embodying a certain number of contaners, groups of containes connected on their upper part through the plastic blank are then provided, as frequently desired, for example, for the commercialization of yogurts or similar products.

BRIEF DESCRIPTION OF THE DRAWINGS

The invention will be well understood from the description which follows which is given as an example and with reference to the appended drawing in which.

DETAILED DESCRIPTION OF PREFERRED EMBODIMENT

Figure 11:
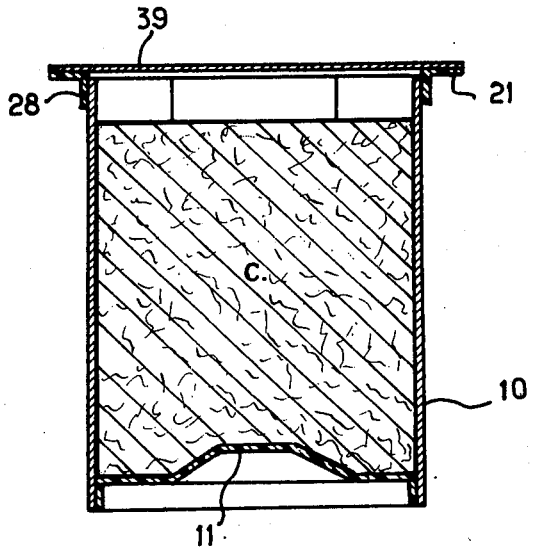
FIG. 11 is a view similar to that of FIG. 10 but after cutting out of the cover and its supporting flange.
Figure 12:
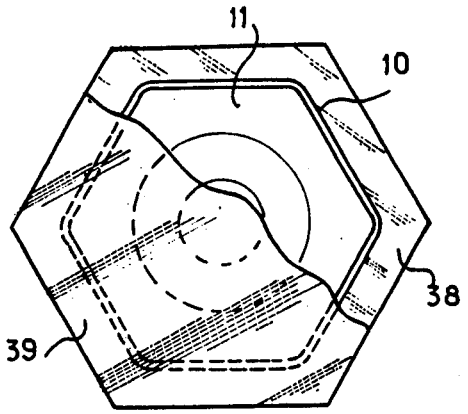
FIG. 12 is a top view, partially broken away, of the packing container shown in FIG. 11.

A container according to the invention, which may be a packing container, but also a container of the tumbler type, comprises, mainly, as shown in FIGS. 11 and 12, a cardboard sheath or lateral wall 10 and a bottom 11, made of plastic material, tightly fastened to the sheath 10. The latter is of cylindrical shape or is advantageously prismatic in order to facilitate its manufacture, handling and storage in the usual machines for working cardboard and, although it is described and illustrated below in a hexagonal cross section embodiment, no restrictive character whatsoever must be associated with this particular shape.

Figures 4, 6, 7, 8, 9, 10:
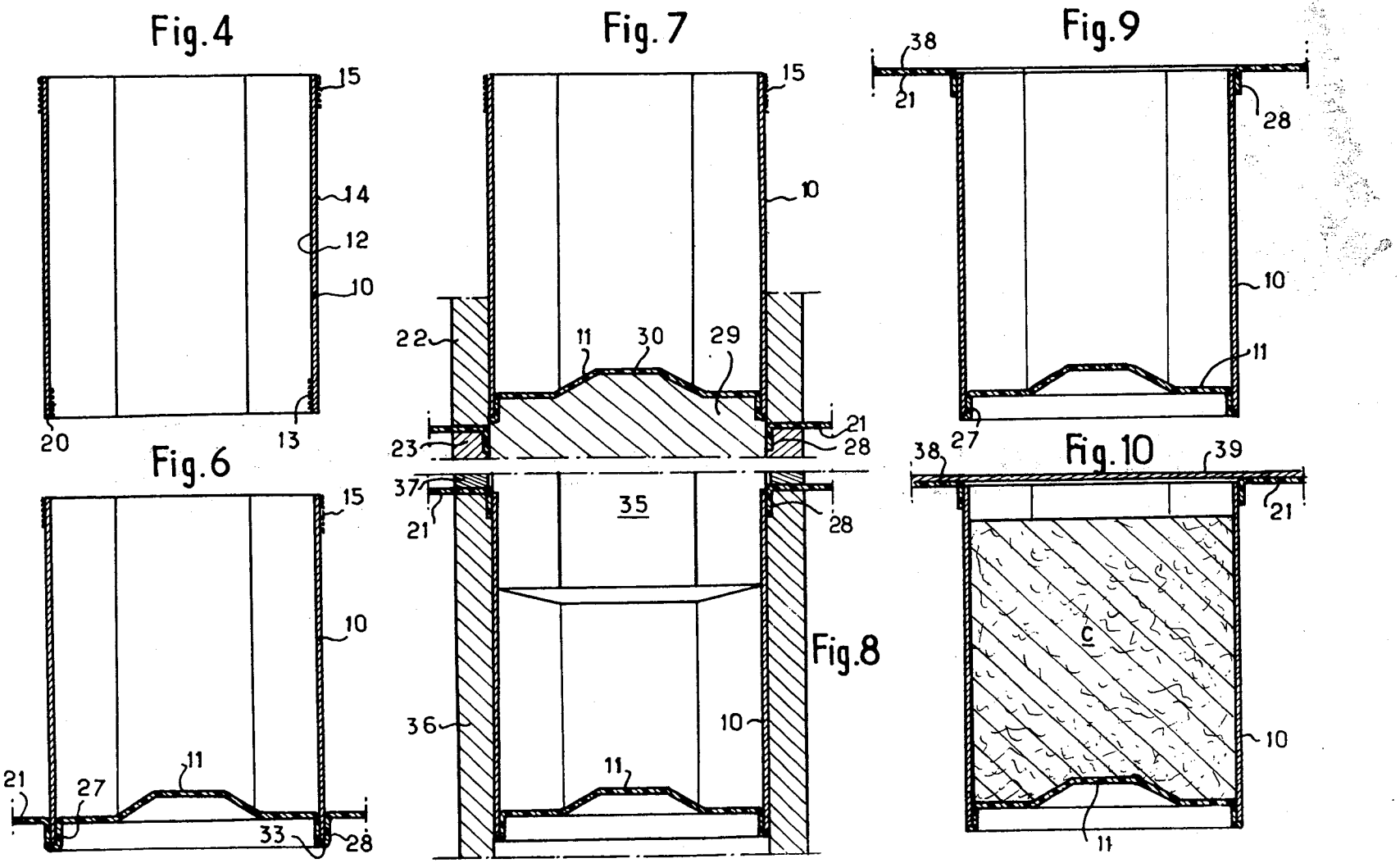
FIG. 4 is a longitudinal sectional view of the cardboard sheath of a container according to the invention.
FIG. 6 shows an intermediate step in the method for the manufacture of a container according to the invention.
FIG. 7 illustrates a subsequent step in the manufacturing method.
FIG. 8 illustrates the fastening step, on the end of the sheath opposite to the bottom, of an external flange.
FIG. 9 shows a packing container at the end of the step illustrated in FIG. 8.
FIG. 10 shows a packing container according to the invention provided with the packed product and closed with a covering member.

The cardboard sheath 10, which is obtained using ordinary cardboard cutting out, grooving and bonding machines, has, on its internal wall 12, FIG. 4, and close to one of its ends a margin 13 of a film of material having thermoweldability or thermobonding characteristics, for example, a plastic film the thickness of which is of the order of several dozen microns. This margin, which prevails on a small fraction of the length of the sheath, is fixed on the cardboard of the sheath using known coating or adhesion techniques and the material which comprises it is chosen so that there exists between it and the plastic material making the bottom 11, a thermobonding or thermowelding affinity, it being understood that both the film of material making margin 13 and the plastic sheet from which bottom 11 is thermoformed, in a manner which will be described below, may be simple or composite film and sheet.

Although in certain embodiments margin 13 is fixed as a small band on the internal surface of sheath 10 it forms, in other embodiments the end zone of a lining prevailing on the entire internal surface 12 of the sheath.

The invention provides, in addition, that the end part of the sheath opposite that which bears margin 13, have on its external surface 14, a band 15, substantially of the same length as margin 13, made of a thermosealing varnish which has the property of hot welding the plastic material to the cardboard, or of a plastic film, which may be identical with or different from that which comprises margin 13 but which is also chosen so as to have a certain thermobonding or thermowelding affinity with the simple or composite material comprising the plastic sheet from which bottom 11 of the container is thermoformed.

Figure 2:
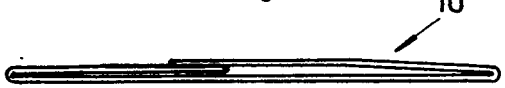
FIG. 2 is an end view of an embodiment of a preliminary shape such as stored in the reserve of the delivering mechanism shown in FIG. 1.
Figure 3:
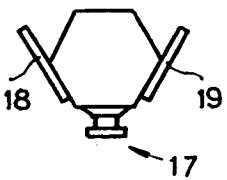
FIG. 3 is a schematic view showing the forming means for the sheath at the exit of the delivering mechanism.
Figure 1:
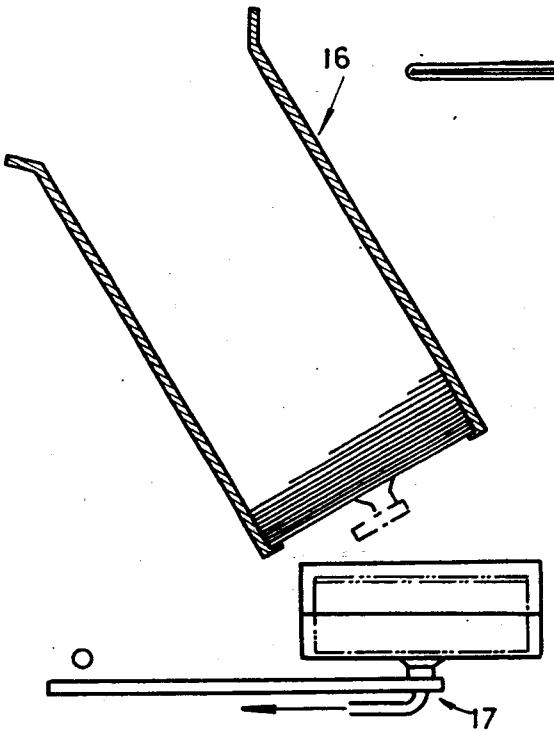
FIG. 1 is a schematic view of a mechanism for delivering preliminary shapes of cardboard sheaths equipping a machine according to the invention.

For the manufacture of the latter, a sheath 10, which is then as seen in FIG. 2, i.e., folded back around its grooving lines, is extracted using a pneumatic suction device 17 from a magazine 16, FIG. 1, from a delivering mechanism in which it is stored in a flat condition, and the sheath is unfolded by means shown schematically in 18 and 19 in FIG. 3 so as to constitute, in the example described and shown here, a box with a hexagonal cross section opened at both its ends.

Figure 5:
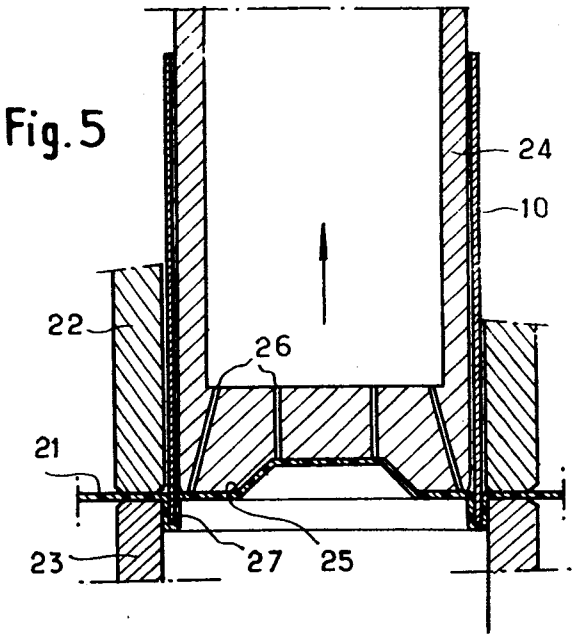
FIG. 5 illustrates the thermoforming method of a bottom of a container according to the invention.
Figure 7A:
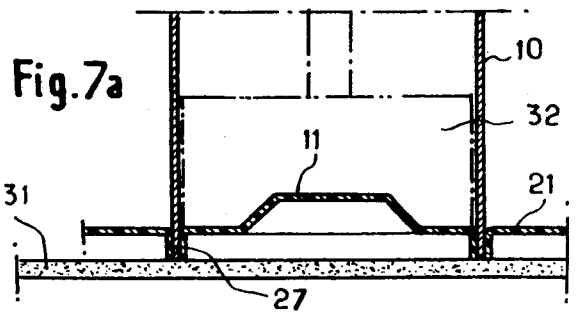
FIG. 7*a* is a view similar to that of FIG. 7 but for an alternative embodiment.

The edge 20 of the end of the sheath adjacent to margin 13, is used as part of the mold provided for the thermoforming of bottom 11 from a simple or composite plastic sheet. As can be seen in FIG. 5, the plastic sheet 21, which is first softened using heating means as is usual in the thermoforming technique, is maintained between plates 22 and 23 cut out along perforations having a contour of the same shape as that of the sheaths but of a slightly larger size. While the plastic sheet is thus maintained, sheath 10 and a mandrel 24 which it contains are simultaneously brought into contact with sheet 21, so that the front face 25 of mandrel 24, which is pierced with crossing passages 26, comes into contact with the plastic sheet 21, while sheath 10 is pushed into said sheet, which is then in a plastic state, from a height substantially corresponding to the length of margin 13. By making a source of depression operative to which are connected the crossing passages 26 of mandrel 24, the plastic sheet 21 is deformed so as to give rise to bottom 11, the contour of which is exactly that of the sheath which provided it and which has a peripheral rim 27 in correspondance of the length of the sheath 10 projecting with respect to the front face 25 of mandrel 24. Simultaneously, with the shaping of plastic sheet 21, application of the latter on margin 13 induces the thermobonding or thermowelding of the peripheral rim 27 onto said margin and makes the sheath tightly integral with the thermoformed plastic sheet. When plates 22, 23 are drawn apart, and mandrel 24 is removed, the condition is that shown in FIG. 6, i.e., the sheath 10 is integral with the plastic sheet 21 which shows not only the rim 27 but also a flange 28, external to the sheath but not attached to the latter because of the non-weldability of cardboard to the plastic material comprising sheet 21. A tool having a shape conjugated with that of the sheath may contribute to the thermoforming of bottom 11, with or without depression, as will be described hereafter with reference to FIGS. 15 to 18.

In order to separate the bottom 11 of the container from the rest of the plastic sheet 21, a procedure is used whereby, as shown in FIG. 7, said sheet is sheared in front of flange 28. In order to carry out this operation, a punch 29, the front face 30 of which has a shape conjugated with that of bottom 11, induces the relative displacement of sheath 10 and bottom 11 with respect to sheet 21 which is maintained in position by plates 22 and 23 or similar plates.

Alternatively, and as shown in FIG. *7a*, the assembly formed by sheath 10 and plastic sheet 21 which is integral with the sheath through rim 27 of bottom 11 is brought opposite an abrasive tool 31 on which it is applied by a mandrel 32 introduced inside the sheath, and the front end face of which has a shape conjugated with that of bottom 11. Under the action of tool 31, the bridging portion 33 connecting rim 27 and flange 28, FIG. 6, is broken and sheet 21 is parted from sheath 10 which, of course, remains attached to bottom 11 due to the thermowelding or thermobonding of the rim 27 of the latter on margin 13.

The container obtained at the end of the manufacture phase illustrated in FIGS. 7 or *7a* thus comprises a cardboard sheath to which is tightly attached a bottom made of thermoplastic material. This container may be used as such, for example, as a tumbler or similar object or, after filling, it may be sealed at its upper part using an appropriate cover.

For the manufacture of packing containers designed to contain foods, for example milk products such as yogurts, creams or similar foods, it is contemplated to use flange 28 formed from the plastic sheet 21 during the production phases described above, in order to provide, at the upper part of the container, opposite to the bottom 11, a bearing surface which may receive a cover or lid, for example fixed by thermowelding techniques, of aluminum foil or similar material.

In that purpose, sheath 10, the upper part of which was previously lined with band 15 made of plastic material or of a thermosealing varnish, or which then receives this band, is displaced with a relative motion with respect to the plastic sheet 21 until flange 28 is brought into contact with band 15, FIG. 8. With the sheath positioned by a tool 35, the heating of the contact zone between flange 28 and band 15, by means 36 and 37 which come into contact with sheet 21 and maintain it simultaneously into position, ensures the thermobonding or thermowelding of said sheet on the external face of sheath 10; the container is then shown in FIG. 9. After a passage in front of a to be packed product filling station, it can be directed to a device which applies on the surface 38 extending flange 28 of the plastic sheet 21, an aluminum foil or similar material 39, tightly attached to said surface 38 by thermowelding or thermobonding using a thermosealing varnish or similar means.

After attachment of sheet 39 making the cover on the container which contains packed product C, and which is then as shown in FIG. 10, simultaneous cutting out of sheet 39 and of plstic sheet 21 provides the container shown in FIGS. 11 and 12.

Figure 14:
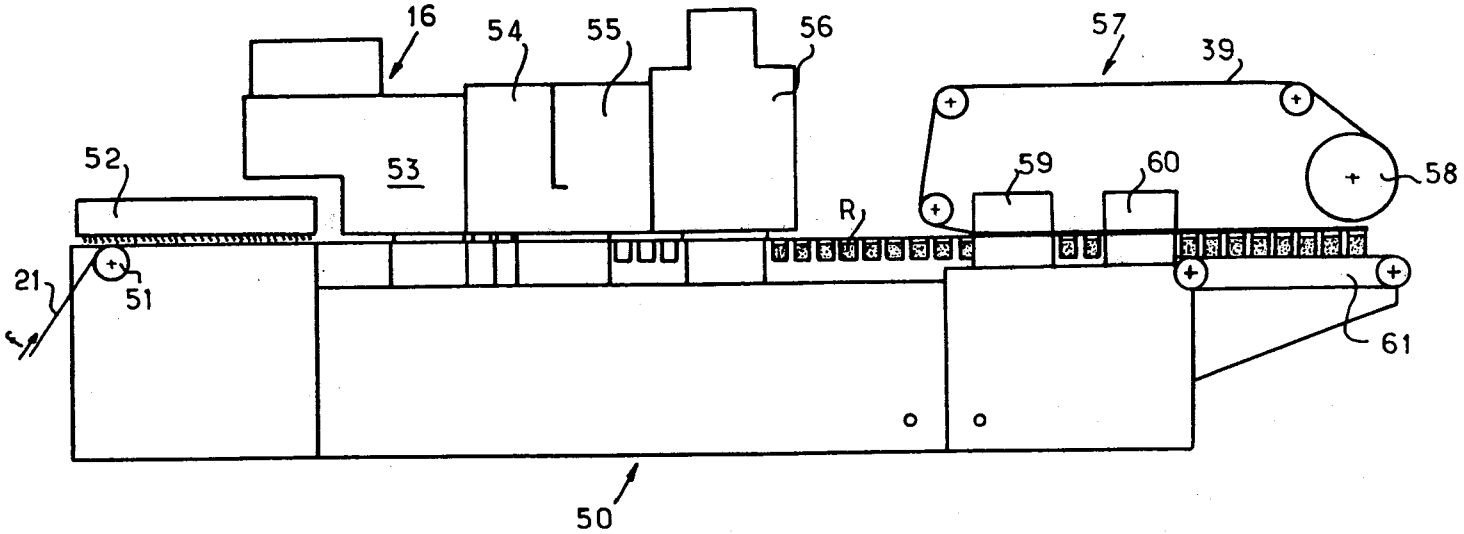
FIG. 14 is a schematic elevational view of a machine for carrying out the method according to the invention.

Although the method has been described above for the manufacture of a container, it is preferably carried out in order to manufacture simultaneously, continuously or semi-continuously, a plurality of containers, advantageously using a machine 50. The latter, as shown in FIG. 14, receives at its upstream end the simple or composite plastic sheet 21 which, guided by a roller 51, first passes in front of heating means 52 intended to induce its softening before thermoforming at a station 53. The latter is fed with sheaths 10 from the delivering mechanism 16 and comprises means, not shown, which place a plurality of sheaths according to a predetermined geometric distribution, for example, in lines and columns, coinciding with the distribution of the mandrels 24 and of the openings of plates 22 and 23. At the exit of station 53, the simple or composite plastic sheet 21 is thus shaped according to a plurality of bottoms 11 with which sheaths 10 are integral.

Figure 13A:
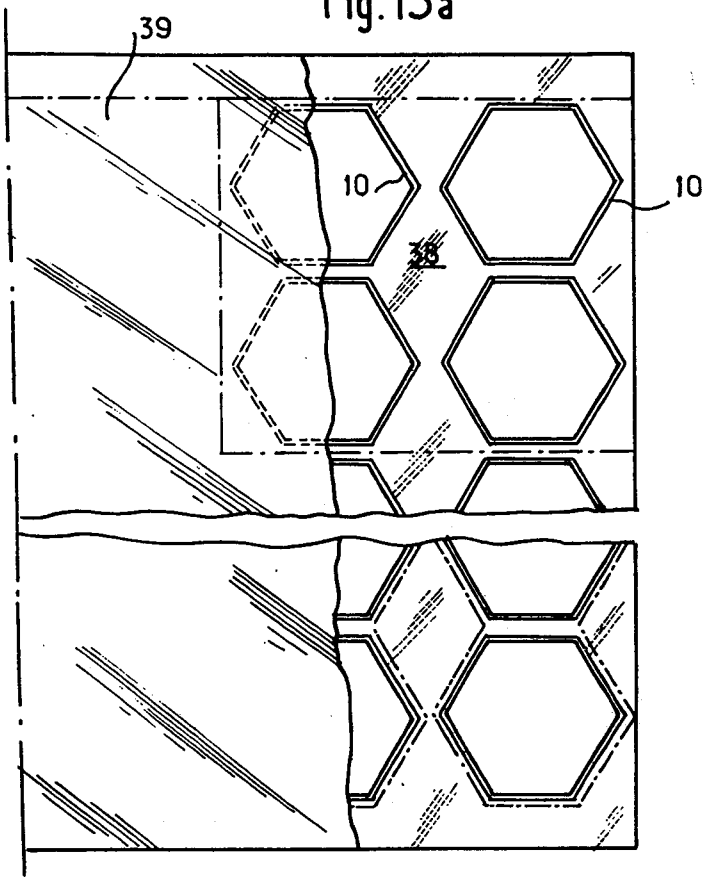
FIG. 13*a* is a bottom view, partially broken away, of a plurality of packings according to the invention after setting into place of closing covers using aluminum foil or similar material.
Figure 13:
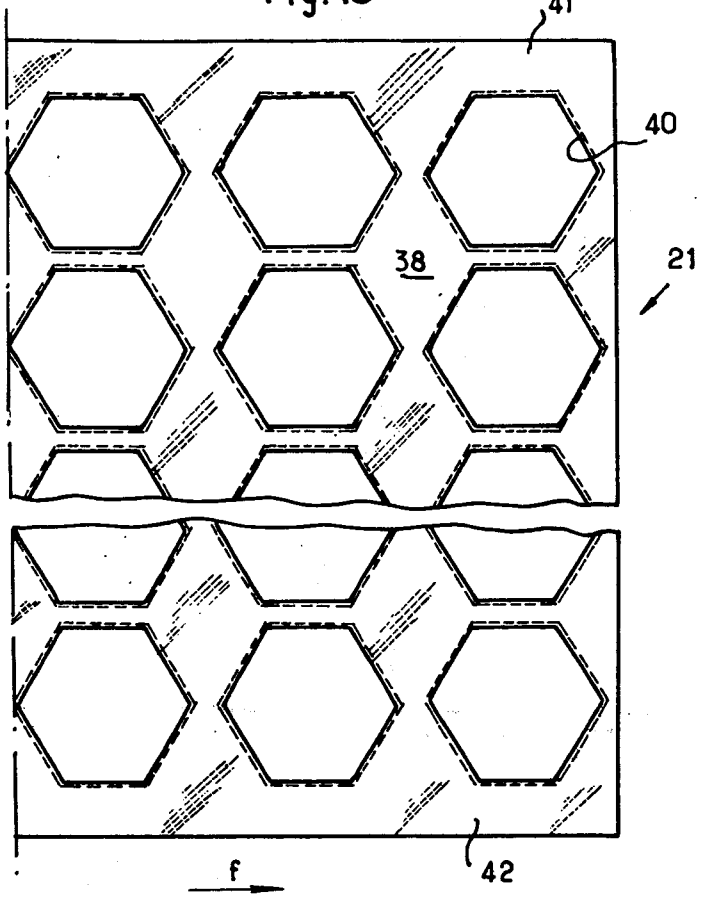
FIG. 13 shows, as a top view, a simple or composite plastic sheet from which container bottom according to the invention have been formed.

At station 54, adjacent to station 53, the bottoms 11 of the containers are, either through shearing or abrasion or tearing away, or still further through a thermal process or another process, separated from the rest of sheet 21 and, at the exit of this station, sheet 21 is as shown on FIG. 13, i.e., is pierced with openings 40 each having the contour of the cross section of a sheath 10. The openings 40 are distributed all along the width of sheet 21, between bands 41 and 42 through which said sheet is held laterally upon its motion through the machine in the direction of arrow *f*, for example, along *n* columns each with *p* openings if the number of containers simultaneously manufactured is $n \times p$, the forward motion spacing of the machine being *n* times the largest longitudinal dimension of the containers.

At station 55 which follows station 54 in the direction of passage of sheet 21, the operation illustrated in FIG. 8 is carried out on a plurality of containers, i.e., the hollowed-out plastic sheet 21, such as illustrated in FIG. 13, is displaced with respect to the sheaths provided with their bottoms in order to attached said sheet by thermobonding or thermosealing on the upper part of the containers.

After passages below a to be packed product C filling station 56, the containers R, connected to each other by their upper part through the zones 38 of the plastic sheet 21 which prevail between the openings 40, can be closed in an ordinary machine 57 for setting into place covers or lids made of aluminum foil or similar material 39 unrolled from a reserve 58. The operation of thermosealing or thermobonding the covers occurs at station 59 of machine 57 and, at the exit of this station, all the containers, filled and sealed, are as shown in FIG. *13a*, i.e., said containers are connected to one another through the zones 38 of the plastic sheet 21 integral with said containers through its flanges 28.

After passage in a cutting station 60 for the zones 38 of sheet 21 and sheet 39, the containers are taken up by a discharge conveyor 61. The cutting carried out at station 60 is chosen as a function of the requirements of the users of machine 57. It may be carried out in order to form separate containers or to form a group of containers connected to one another, for example a group of four with a cutting pattern as shown in mixed dashes in the upper part of FIG. 13*a*. The cutting pattern may be, of course, of any shape, for example as shown in mixed dashes in the lower part of FIG. 13*a* when it is desired to group the containers two by two and according to a contour which is similar to that of the cross section of the containers.

In a preferred embodiment, the machine according to the invention comprises at the forming station 53 a plurality of plungers 100, each having a cross section corresponding to that of sheath 10, the base 101 of which has a shape conjugated with that desired for bottom 11 of the container (FIGS. 15 to 18). The machine also comprises, at said station, matrixes 102 each surrounding a sheath 10, the cutting edge 103 of which projects slightly with respect to the edge 20 of the sheath, the edge 103 forming the end of a ring which presents, on its external surface 104, a slight conicity. On the face of the plastic sheet 21 opposite to that facing plungers 199 and matrixes 102, the machine comprises counter-plungers 105 with an end surface 106 also conjugated with that of bottom 11 and counter-matrixes 107, the end surface 108 of which has a conicity conjugated with that of the ring of matrix 102.

Figure 18:
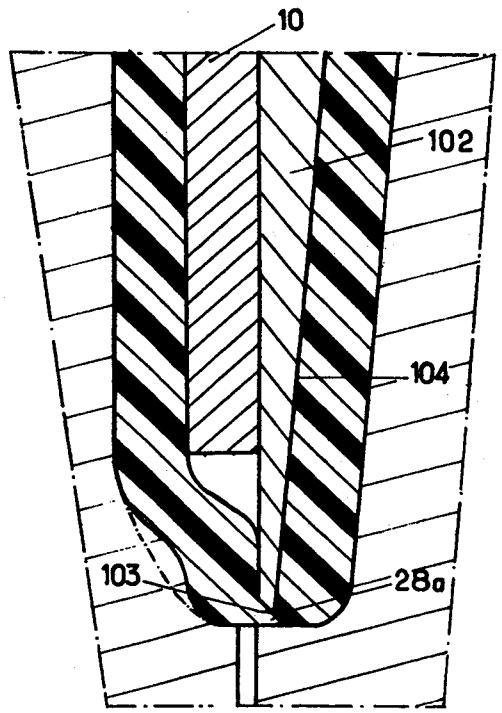
FIG. 18 is a view with a larger scale illustrating the deformation of a plastic sheet during thermoforming of the bottom of the container.

As a varying embodiment, the counter-plungers 105 are shaped as shown in mixed dashes in FIG. 18.

Figure 16:
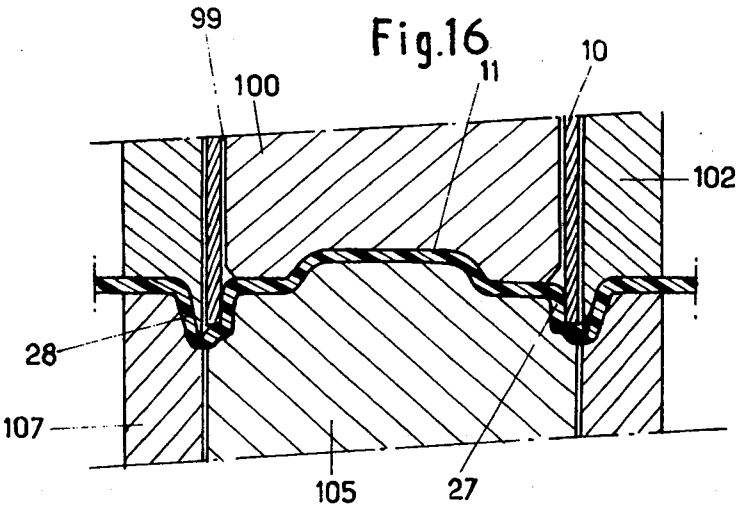
FIG. 16 is a view similar to that of FIG. 15 but for another condition.
Figure 17:
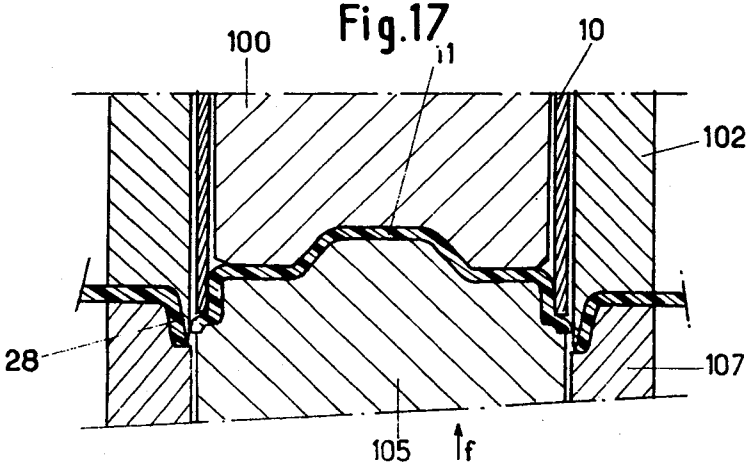
FIG. 17 is a view similar to that of FIGS. 15 and 16 but for still another condition.
Figure 15:
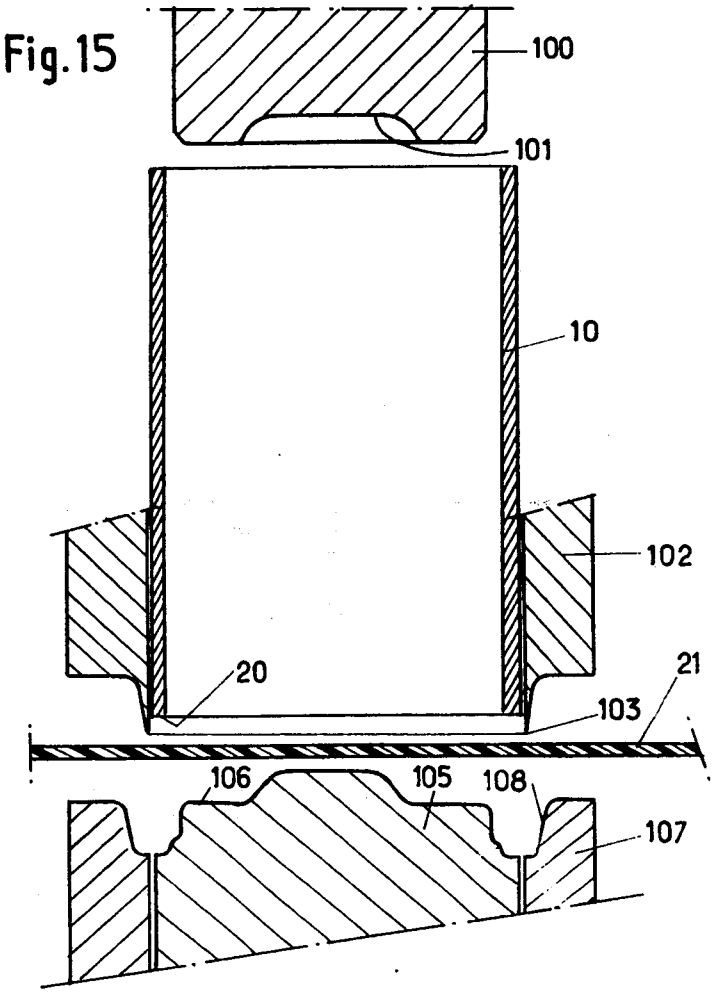
FIG. 15 is a schematic view of a part of the machine shown in FIG. 14 previous to the phase of shaping of the bottom.

In order to shape plastic sheet 21 according to bottoms 11 on the one hand, and to make said bottoms integral with the ends of sheaths 10 on the other hand, the plungers 100 and the counter-plungers 105-counter-matrixes 107 assembly are displaced so as to bring them near each other until these members are brought into the condition shown in FIG. 16 in which each thermoformed bottom 11 of a container is integral with a sheath 10 through a peripheral rim 27 provided in sheet 21 by said sheath. If necessary, a depression may also be used which is transmitted through the interval 99 existing between a sheath 10 and a plunger 100 for the shaping of bottom 11. During the operation described above, each matrix 102 and each counter-matrix 107 form, in the plastic sheet 21, a flange 28 which is separated from bottom 11 at station 54 by breaking away a part 28*a* of the plastic sheet during the phase illustrated in FIG. 17 and during which each counter-plunger 105 is displaced in the direction of arrow *f* with respect to the counter-matrix 107 and the matrix 102 which are associated to it, taking with it plunger 100 and bottom 11.

In a first embodiment of the machine according to the invention, the sheaths 10, previously lined with a strip 15 made of plastic material or comprising a thermosealing varnish, are brought by a relative displacement with respect to the plastic sheet 21, at station 55 in front of rings 110, the internal surface of which is pierced with an opening 111 for the projection of hot air.

Figure 20:
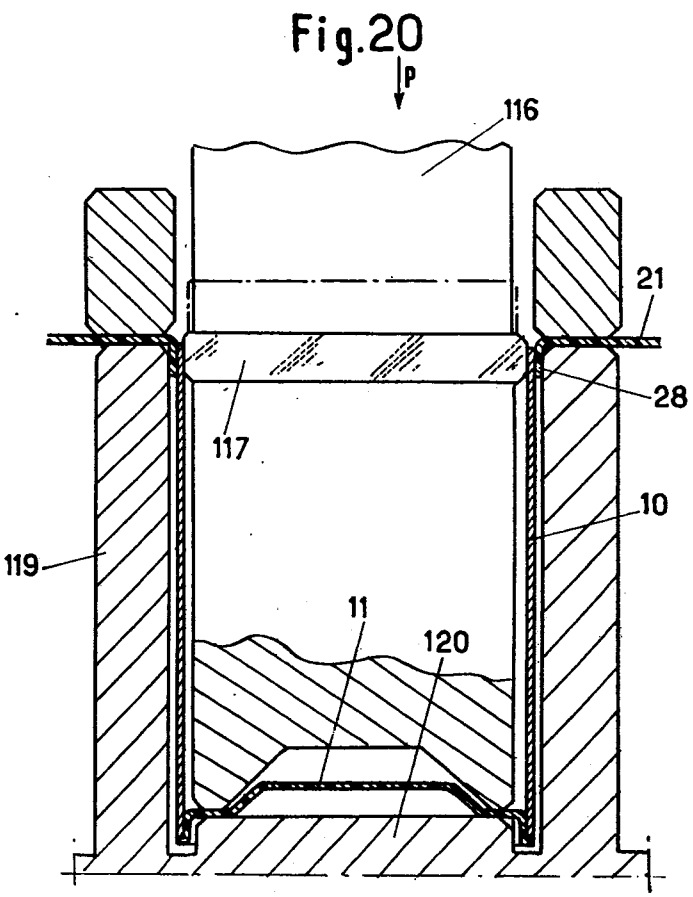
FIG. 20 is a view similar to that of FIG. 19 but for another condition.
Figure 19:
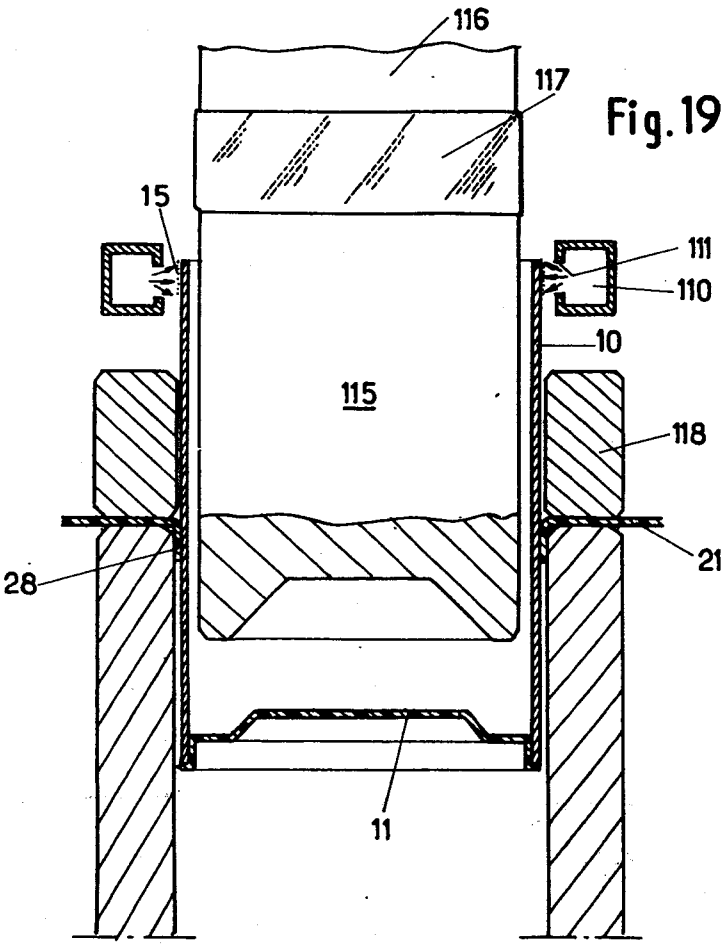
FIG. 19 is a schematic view of a part of a machine according to the invention showing means for attachment of a flange with the end opposite to the bottom of a container according to the invention.

Sheet 21 on which depend the flanges 28 being maintained in a tight condition between a clamp 118 and a counter-clamp 119 with a bottom 120 having a shape conjugated with that of the bottoms 11 of the containers, FIG. 20, a plunger 115 is introduced into each sheath 10, which plunger is connected to a rod 116 through a deformable block 117, for example of rubber, until the sheath is brought into the condition shown in FIG. 20 in which the strip 15 previously heated is in front of flange 28.

Sheath 10 and bottom 11 which is integral with it being maintained by the bottom 120 of counter-clamp 119, a pressure applied on rod 116 along the direction of arrow *p* induces the deformation of block 117 which applies with the required force strip 15 of the sheath against flange 28 for their respective attachment.

Figure 21:
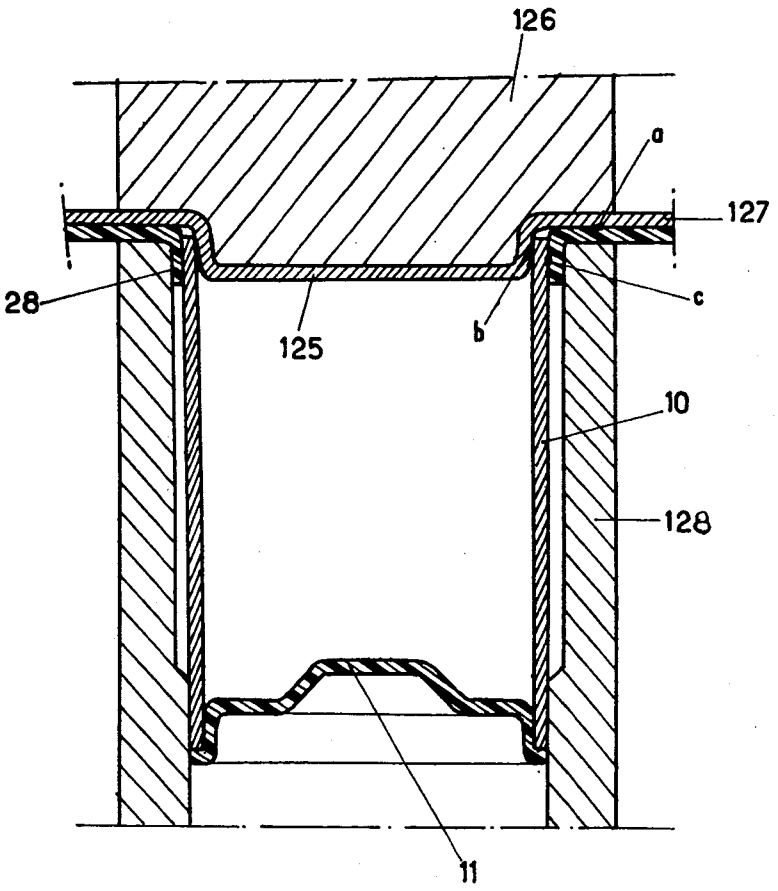
FIG. 21 is a view similar to that of FIGS. 19 and 20 but for another embodiment.

In another embodiment, FIG. 21, the operations for the attachment of a flange 28 onto strip 15 of the sheath and the application of a closing lid 125 for the container are carried out in one and the same phase. For this purpose, a punch 126 provided with heating means (not shown) is applied onto an aluminum foil or similar material 127 intended to close the container, whereas sheath 10 and flange 28 are maintained by a device 128, also provided with heating means (not shown), which surrounds flange 28 and sheath 10. A thermosealing varnish or similar material having been fixed onto the aluminum foil in zones shown as *a* and *b*, i.e., in zones corresponding to the application of said sheet onto the flange 28 on the one hand, and on the internal face of the sheath, on the other hand, the maintenance under pressure between device 128 and punch 126 of the aluminum foil 125, of the sheath 10 and of the flange 28 induces the thermowelding or thermobonding of the aluminum foil onto the flange in the zones shown as *a*, the thermowelding or thermobonding of said aluminum foil onto the cardboard sheath 10 in the zones shown as *b*, and also the attachment of the sheath and the flange 28 in the zones shown as *c* which are those on which prevails the previously mentioned strip 15.

For the manufacture of the containers according to the invention and when a plastic film lines the totality of the internal face 12 of the sheath, the choice of said film is a function of the end use of the container. If the latter is not intended to hold a food, the film may be made of acrylonitrilebutadiene-styrene (ABS), high or low density polyethylene, polypropylene, methacrylene-butadiene-styrene (MBS), polystyrene, polyvinyl chloride, polyester or similar materials. In the case of a container intended to contain milk products, the film is advantageously made of polystyrene, whereas it may be made of polyethylene for packing fruit juices or similar products. It may further be made of high density polyethylene or of polypropylene when the product to be packed is hot-conditioned, the use of a polyvinylidene chloride film (PVDC) being appropriate when it is desired to protect the packed product against oxygen in the air.

After determination of the nature of the film covering the interior of the sheath or only fixed according to a margin, the simple or composite plastic sheet intended to provide the bottom 11 of the container through thermoforming is chosen in connection with the film so that a certain thermobonding or thermowelding affinity exists between the film and the sheet.

In addition to the advantages already mentioned concerning mechanical quality, tightness, sanitary characteristics and the cost of the containers according to the invention, the use of a cardboard sheath, which may be easily printed at low cost, makes it possible to eliminate the difficulties inherent either to the printing of plastic materials or to the wrapping of the sheath with a jacket made of paper or similar material comprising the desired impressions for the identification of the packed product.

The invention comprises the containers the sheath of which is made of cardboard treated by or coated with paraffin, "hot-melt" coating, adhesive "hot-melt", varnish or other material which may be suitably deposited on a surface.

The coatings may be applied inside and outside for the purpose of total waterproofing and may contribute to various stages of the manufacture of the containers: thermosealing of the bottom inside the container, non-thermosealing of the sheet from which the bottom is made on the outside of the container, thermosealing of the flange.

The invention provides for the waterproofing of the edges of the the sheath, whether these are the upper or lower edges of the contour or the part coming into contact with the packed product at the level of the bonding flap. For this purpose, it provides either the use of cardboard treated within its mass with a product certified for its contact with food products, or a spray of varnish or of another waterproof coating on the edges.

I claim:

1. A method for the manufacture of a container comprising a cardboard sheath and a plastic bottom, the method comprising the steps of:

shaping the bottom by thermoforming of a plastic sheet using the sheath to provide a peripheral U-shaped rim in the plastic sheet having the same cross section as that of the sheath;

making the rim integral with the sheath by bonding the rim with the lowermost portion of the inner surface of the sheath;

parting the excess, on the exterior of the sheath, of plastic sheet used to make the bottom from the bottom such that the remaining plastic sheet has a downwardly extending flange juxtaposed and adjacent to the outer wall of the container sheath and a horizontally extending flange integral with the downwardly extending flange;

moving relatively the remaining plastic sheet with the downwardly depending flange and the sheath to position the downwardly depending flange about the outer topmost portion of te sheath; and making the downwardly depending flange integral with the sheath by bonding the flange with the outer topmost portion of the sheath.

2. A method as claimed in claim 1, wherein the sheath includes a film of material with thermobonding characteristics lining the interior of the sheath at least close to the bottom end thereof, and a band of thermobonding means lining the external part of the sheath close to the end thereof opposite to that of the bottom, wherein said step of bonding the peripheral rim with the lowermost portion of the inner surface of the sheath comprises thermobonding on a margin of the film, wherein said step of bonding the depending flange with the outer topmost portion of the sheath comprises thermobonding of the band with the depending flange, and wherein said thermobonding means is selected from the group consisting of a band of plastic material and a band of thermosealing varnish.

3. A method as claimed in claim 1, wherein said parting step comprises causing the plastic sheet to tear substantially at the bottom of the U-shaped rim by moving the sheath relative to the plastic sheet.

4. A method as claimed in claim 1, wherein said parting step comprises removing the bridging bottom portion of the U-shaped rim by abrasion.

5. A method as clamed in claim 1, wherein said parting step comprises cutting the downwardly extending flange at the bottom of the U-shaped ring with a punch having a downwardly extending cutting edge installed between the outer surface of the sheath and the inner surface of the depending flange.

6. A method as claimed in claim 1, further including the step of applying a closing cover on the container by bonding the cover to the horizontally extending flange of the remaining plastic sheet, after said step of bonding the downwardly depending flange with the outer topmost portion of the sheath.

7. A method as claimed in claim 6, wherein the closing cover includes a depending flange corresponding in shape to the inner periphery of the topmost portion of the sheath, and further including the step of bonding the depending flange of the cover to the inner topmost portion of the sheath, and wherein said steps of bonding the closing cover to the horizontally extending flange of the plastic sheet, bonding the downwardly extending flange of the plastic sheet to the outer topmost portion of the sheath, and bonding the depending flange of the closing cover to the inner topmost portion of the sheath are realized simultaneously.

8. A method for the simultaneous manufacture of a plurality of containers, each comprising a cardboard sheath and a plastic bottom, comprising:

shaping the bottoms of all the containers by thermobonding of a plastic sheet using the sheaths of the containers in order to provide on each bottom a peripheral U-shaped rim in the plastic sheet having the same cross section as that of the corresponding sheath;

making the rim of each bottom integral with the sheath with which it is associated by bonding the rim with the lowermost portion of the inner surface of the sheath;

parting the excess, on the exterior of each sheath, of plastic sheet used to make the bottoms from the bottoms such that the remaining plastic sheet has downwardly extending flanges juxtaposed and adjacent to the respective outer walls of the contianer sheaths, and horizontally extending zones integral with the downwardly extending flanges between the recesses defined by the downwardly extending flanges;

moving relatively the remaining plastic sheet with downwardly depending flanges and the sheaths to position the downwardly extending flanges of the plastic sheet about the outer topmost portions of the sheaths; and making the downwardly depending flanges integral with the respective sheaths by bonding the flanges with the respective outer topmost portions of the sheaths, so that all the containers of the plurality of containers are connected to one another through the horizontally extending zones of the plastic sheet.

* * * * *